US005103721A

United States Patent [19]

Chou et al.

[11] Patent Number: 5,103,721

[45] Date of Patent: Apr. 14, 1992

[54] ALUMINUM CAN RECYCLING APPLIANCE AND METHOD

[75] Inventors: Albert S. Chou, Monte Sereno; Donald J. Massaro, Atherton; Frank M. Balbas, San Jose, all of Calif.

[73] Assignee: Sjoberg Industries, Inc., Santa Clara, Calif.

[21] Appl. No.: 585,601

[22] Filed: Sep. 20, 1990

[51] Int. Cl.[5] ..... B30B 9/02; B30B 9/32

[52] U.S. Cl. ..... 100/37; 100/35; 100/131; 100/218; 100/902

[58] Field of Search ..... 100/35, 37, 130, 131, 100/218, 245, 282, 283, 902

[56] References Cited

U.S. PATENT DOCUMENTS

| | | | |
|---|---|---|---|
| 1,998,263 | 4/1935 | Townsend | 100/902 X |
| 2,191,488 | 2/1940 | McCowan | 100/902 X |
| 2,560,096 | 7/1951 | Elterman et al. | 100/218 X |
| 2,616,477 | 11/1952 | Scheer et al. | 100/902 X |
| 3,807,294 | 4/1974 | Ligh . | |
| 3,845,707 | 11/1974 | Enright et al. . | |
| 4,463,670 | 8/1984 | Thomas . | |
| 4,570,536 | 2/1986 | Dodd . | |
| 4,606,265 | 8/1986 | Meier . | |
| 4,771,685 | 9/1988 | Wagner . | |
| 4,970,951 | 11/1990 | Katz | 100/289 |

FOREIGN PATENT DOCUMENTS

| | | | |
|---|---|---|---|
| 55-45534 | 3/1980 | Japan | 100/902 |
| 57-142797 | 9/1982 | Japan | 100/902 |
| 58-151995 | 9/1983 | Japan | 100/902 |

*Primary Examiner*—Harvey C. Hornsby
*Assistant Examiner*—Stephen F. Gerrity
*Attorney, Agent, or Firm*—Limbach & Limbach

[57] ABSTRACT

A household recycling appliance for recycling aluminum cans. The appliance has a housing containing a vertical crushing chamber with a frontal opening into which an empty aluminum can is to be inserted. The bottom plate of the crushing chamber, serving as a plunger or piston, is advanced upwardly by a motor and bell crank assembly to crush the can against the fixed top plate. As the bottom plate recedes, a spring-operated lever ejects the crushed can rearwardly via a conduit into a can storage receptacle which is sized to hold a selective number of crushed cans. Any residual fluid draining from the crushed can is collected in a fluid storage receptacle located below the can storage receptacle. The can and fluid storage receptacles are removable for transferring the crushed cans and disposing of the fluids.

14 Claims, 6 Drawing Sheets

ALUMINUM CAN RECYCLING APPLIANCE AND METHOD

BACKGROUND OF THE INVENTION

1. Field of the Invention

The present invention relates to recycling appliances, and in particular, to appliances used by consumers for recycling aluminum beverage cans.

2. Description of the Related Art

In recent times, individuals and communities have become more environmentally aware and sensitive. As a result, ecologically oriented activities, such as conservation and recycling, have become more and more commonplace. On one scale, conservation and recycling efforts are aimed at commercial activities. On another scale, such efforts are aimed at household activities. Commercial efforts are often successful due to the larger types of entities typically involved (e.g. corporations) and the relatively little effort required by any one individual. However, household conservation and recycling efforts often fail. Frequently, the reasons for such failure are based upon the inconvenience and mess associated with household recycling efforts.

In attempting to increase individuals' motivation for recycling, many communities have enacted laws requiring curbside trash separation and cash deposits on beverage containers. Other attempts have included community sponsored recycling centers where individuals can deposit materials which would otherwise end up in landfills or incinerators, and receive money based upon their scrap value.

As yet, however, the financial rewards, or penalties, as the case may be, have often been insufficient to compensate for the inconvenience and mess, whether actual or perceived, faced by individuals who participate in such recycling efforts. A common example involves the ubiquitous aluminum beverage can. Used for many beverages, the aluminum can would appear to be a prime candidate for recycling efforts due to its light weight and relatively high scrap value.

However, relative to their weight, and therefore their scrap value, empty aluminum cans require a large amount of space for storage. Furthermore, empty aluminum cans always contain, at least initially, a small amount of residual fluid. This residual fluid can cause an undesirable mess when allowed to drain from and sit among a large group of empty cans. For these reasons, many individuals simply throw away their empty aluminum cans.

To overcome the storage space problem, many forms of aluminum can crushers have been developed and are known in the art. Such can crushers provide a number of ways in which individuals can crush their empty aluminum cans, and thereby save on storage space. However, the problems associated with residual fluids draining from the crushed cans have not been solved.

Therefore, it would be desirable to have an appliance for recycling empty aluminum beverage cans which not only provided means for crushing the cans, but also provided means for dealing with the residual fluids draining from the crushed cans. It would be further desirable to have such a can recycling appliance which automatically provided the full range of household level activities required for recycling aluminum beverage cans, namely, automatic crushing, storage and draining of aluminum cans.

SUMMARY OF THE INVENTION

An aluminum can recycling appliance in accordance with the present invention provides a self-contained means for automatically and safely crushing an aluminum beverage can and storing it for subsequent transfer to a recycling center.

The present invention has a housing containing a crushing chamber with a frontal opening into which an empty aluminum beverage can can be inserted. One plate of the crushing chamber serves as a plunger or piston and is reciprocated within the crushing chamber by a mechanical assembly driven by an electrical motor. The reciprocating plate crushes the aluminum can and a spring-operated lever ejects the crushed can rearwardly into a can storage receptacle which is sized to hold a selected number of crushed aluminum beverage cans.

Further in accordance with the present invention, the appliance housing includes a fluid storage receptacle located below the can storage receptacle for separately collecting and storing any residual fluids draining from the crushed cans.

Both the can and fluid storage receptacles are removable for subsequent transfer of the crushed cans to a recycling center and disposal of the fluids.

These and other objectives, features and advantages of the present invention will be readily understood upon consideration of the following detailed description of the invention and the accompanying drawings.

BRIEF DESCRIPTION OF THE DRAWINGS

Throughout the figures, similar elements are designated with like numerals.

DETAILED DESCRIPTION OF THE INVENTION

Figure 1:
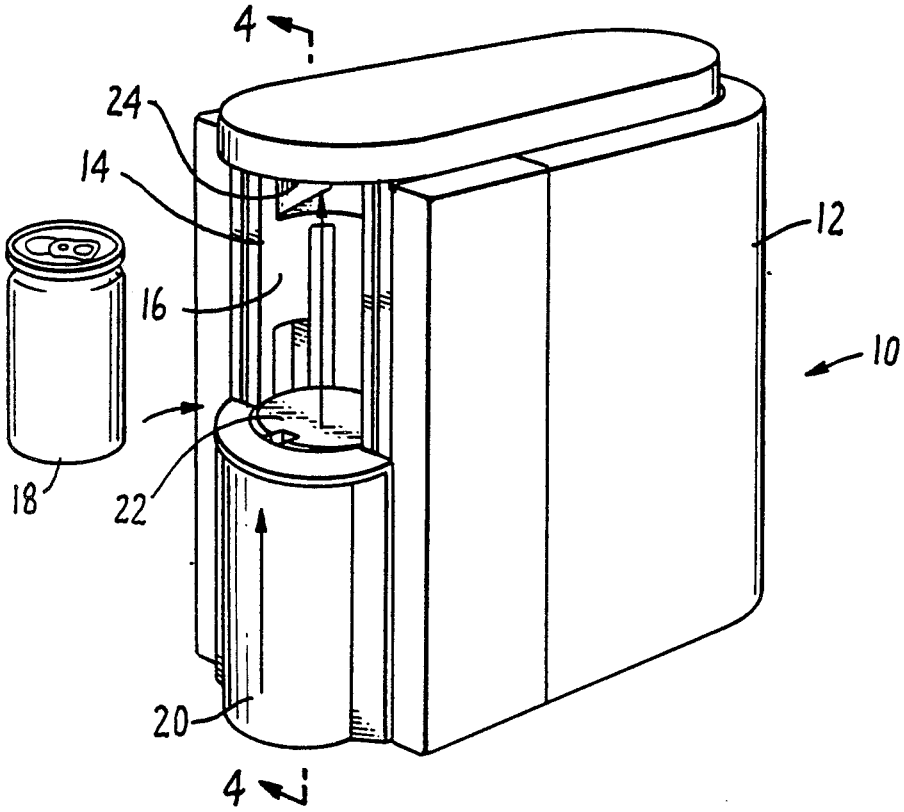
FIG. 1 illustrates a perspective view of an aluminum can recycling appliance in accordance with the present invention.

Referring to FIG. 1, an aluminum can recycling appliance 10 in accordance with the present invention has a housing 12 with a front opening, or aperture 14, providing access to a substantially vertical crushing chamber 16 into which an empty aluminum beverage can 18 can be inserted. As discussed more fully below, once the can 18 has been inserted into the crushing chamber 16, a front door 20 is closed (e.g., by sliding the door 20 upwardly), and the appliance 10 is activated.

Figure 2:
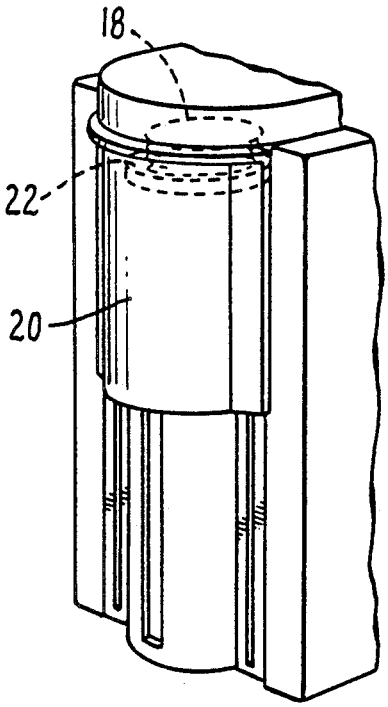
FIG. 2 illustrates a frontal perspective view with the door closed.

Once activated, a lower plate 22 within the crushing chamber 16 is advanced upwardly toward a fixed crushing plate 24 positioned at the top of the crushing chamber 16. As the lower plate 22 advances toward the upper plate 24, the empty can 18 is crushed therebetween. As seen in FIG. 2, after the door 20 has been closed and the appliance 10 activated, the can 18 becomes crushed due to the advancement of the lower crushing plate 22.

Figure 3:
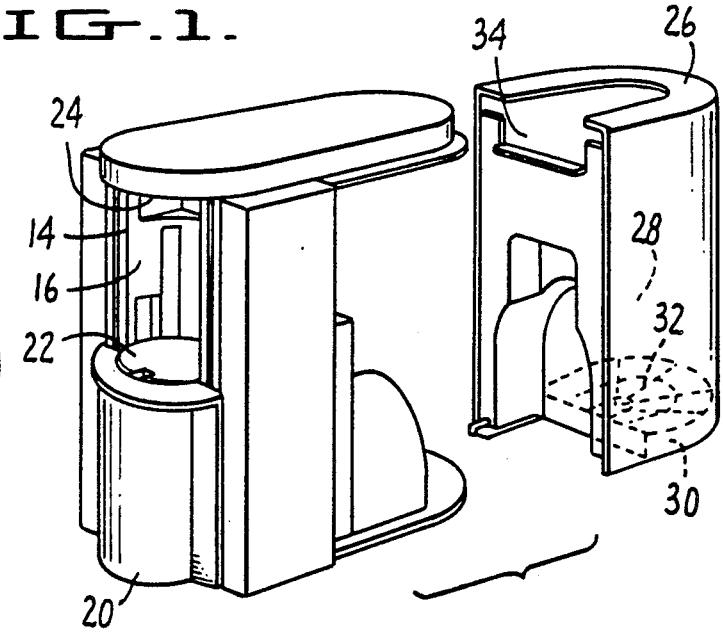
FIG. 3 illustrates a perspective view with the removable can and fluid storage receptacle detached.

Referring to FIG. 3, an appliance 10 in accordance with the present invention includes a storage receptacle 26 for storing cans which have been crushed and any fluids emanating therefrom. The storage member 26 contains a can storage receptacle 28 for storing crushed cans, and a fluid storage receptacle 30 for storing any fluids which emanate, or drain, from the crushed cans within the can storage receptacle 28. The crushed cans (not shown) within the can storage receptacle 28 are separated, e.g. elevated above, the fluid storage receptacle 30 by an apertured member 32, such as a screen. A conduit 34, e.g. an opening, within the storage member 26 provides a means for conveying a crushed can from the crushing chamber 16 into the can storage receptacle 28.

Figure 4:
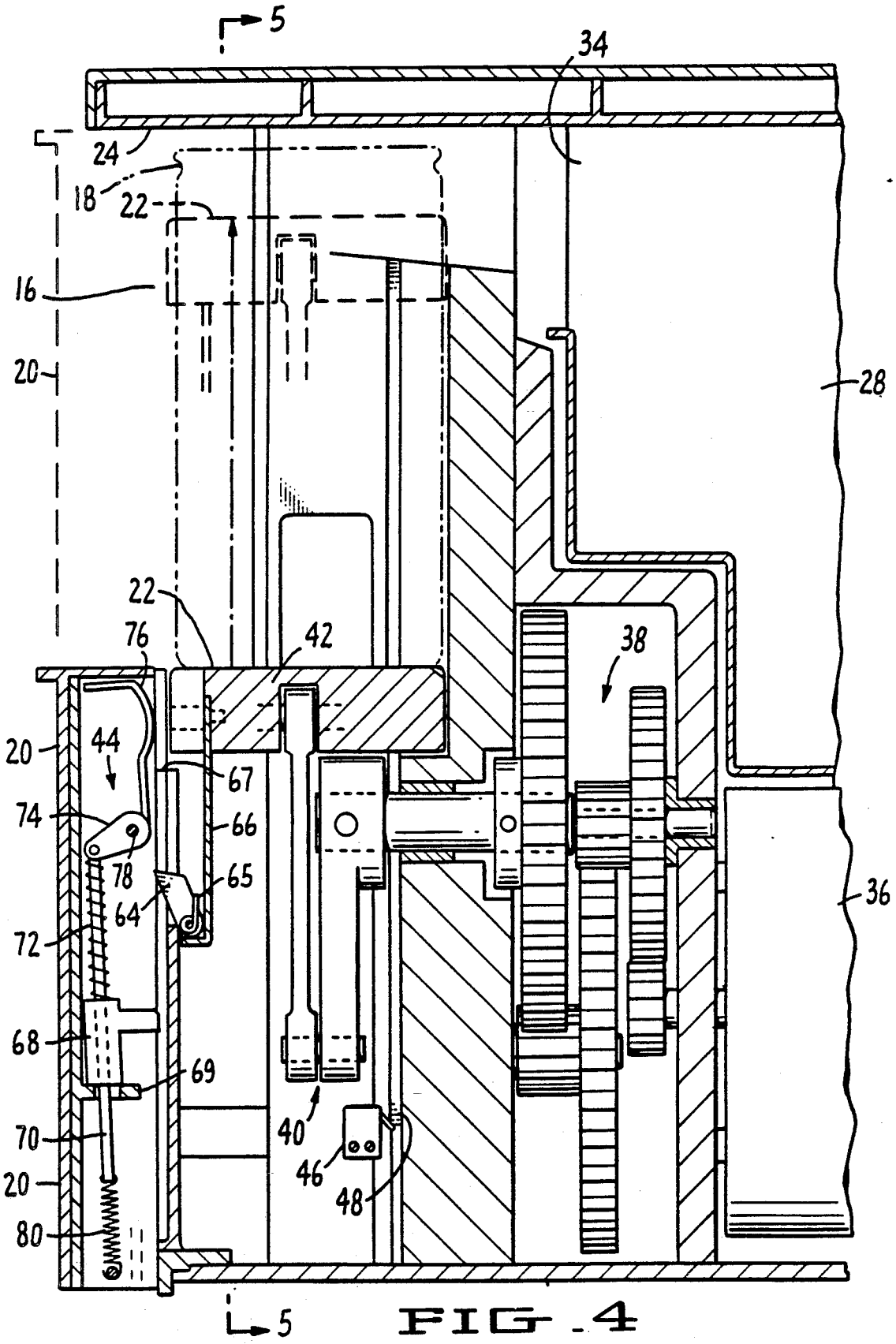
FIG. 4 illustrates a cut-away view taken along line 4—4 in FIG. 1.

Referring to FIG. 4, the primary mechanical elements of an appliance 10 in accordance with the present invention can be seen in a cut-away view taken along line 4—4 in FIG. 1. As discussed more fully below, an electric motor 36 is coupled to reciprocate the crushing plate 22 within the crushing chamber 16 via a gear assembly 38 and bell crank assembly 40. It should be understood that other means of driving the crushing plate 22 can be used, e.g. a belt and pulley assembly (not shown), or gear and chain assembly (not shown), in place of the gear assembly 38.

After an aluminum can 18 is inserted into the crushing chamber 16, the front door 20 is closed by sliding it upwardly. This activates an electrical switch (illustrated in FIG. 11 and discussed more fully below) which activates the appliance 10. The electric motor 36, via the gear 38 and bell crank 40 assemblies, causes the crushing plate 22 to advance upwardly, crushing the can 18 against the top crushing plate 24. The crushing plate 22 is the top surface of a plunger or piston 42 coupled to the bell crank assembly 40. As the plunger 42 recedes away from the top crushing plate 24, the crushed can 18 is ejected into the can storage chamber 28 via the conduit 34 by a spring-loaded can ejector mechanism 44, as discussed more fully below for FIG. 9.

Activating the appliance 10 can be accomplished by means other than an electrical switch mechanically activated by the closing of the door 20. For example, a manually operated electrical switch (not shown) externally mounted on the appliance 10 can be provided. Another type of automatic activation means can include an electronic "can sensor" (not shown) which senses when a can 18 has been inserted into the crushing chamber 16, e.g. via a conductivity measurement which uses the electrical conductivity of the can 18 to complete an electrical connection.

In a preferred embodiment of present invention, the crushing chamber 16 is substantially vertical. This is beneficial in that most of any residual fluid left in the can 18 being crushed will remain therein. Then, once the crushed can is ejected into the can storage chamber 28, the fluid storage receptacle 30 will catch and store any fluids draining from the can. This helps to keep the crushing chamber 16 and lower crushing plate 22 cleaner.

A substantially vertical crushing chamber 16 is further beneficial. It allows ejection of a crushed can 18 (discussed more fully below) to occur sufficiently high enough within the appliance 10 to allow for a can storage chamber 28 large enough to store a reasonably large number of crushed cans (e.g. at least 12 crushed cans). Further, rearward ejection of the crushed cans into a can storage chamber 28 substantially below the ejection point, as shown in FIG. 3, allows the appliance 10 to have an overall height which allows it to be placed upon a typical residential kitchen countertop and fit beneath the overhead kitchen cabinets (not shown).

In a preferred embodiment of present invention, the aperture 14 into the crushing chamber 16 is located in the front surface of the appliance 10 as shown in FIG. 1. However, it should be understood that this aperture 14 can be located virtually anywhere in the front of the housing 12, such as the front left or front right side.

Figure 5:
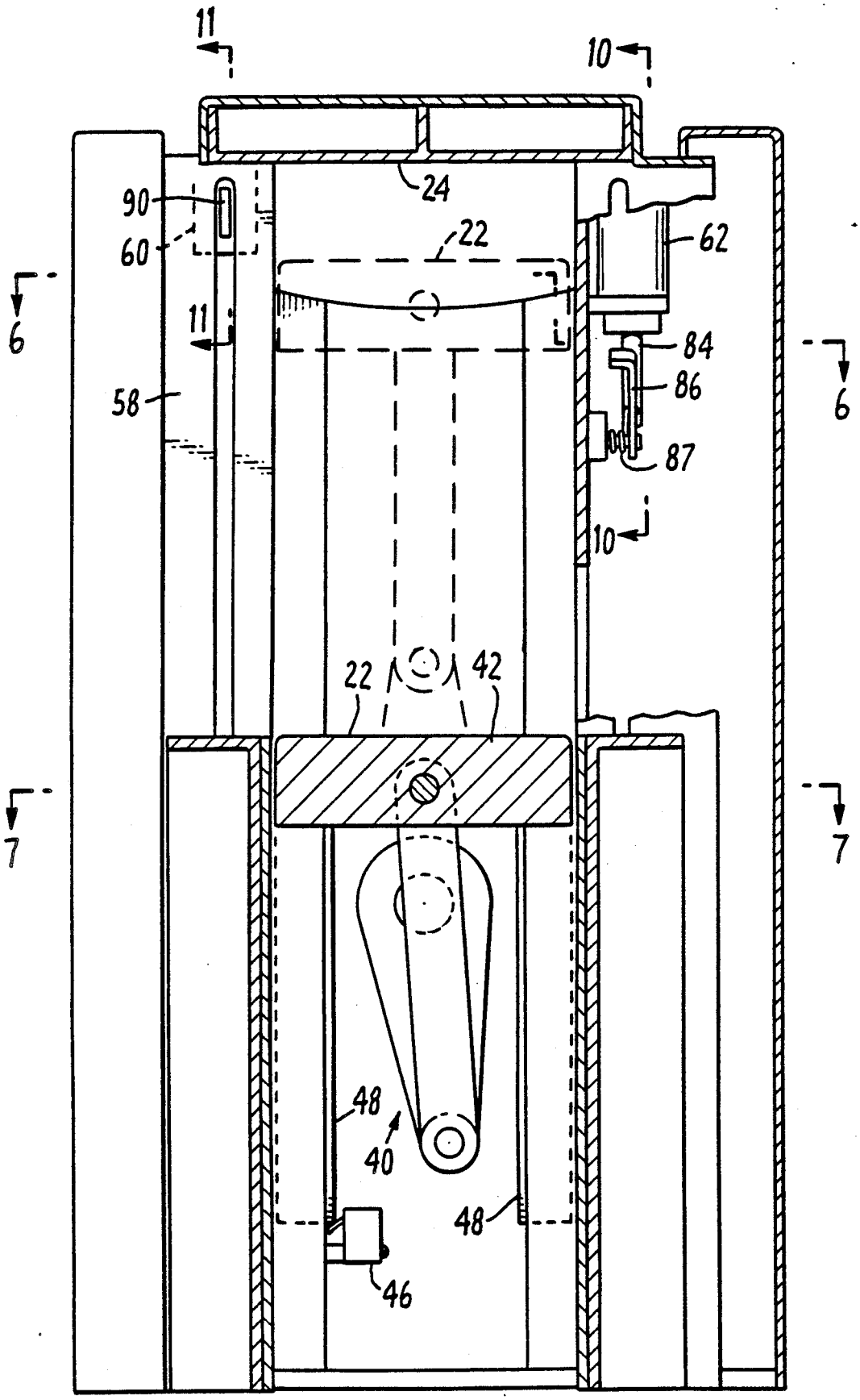
FIG. 5 illustrates a cut-away view taken along line 5—5 in FIG. 4.

Referring to FIG. 5, the plunger 42 and bell crank assembly 40 can be seen in their normal, or "home," position. When in this home position, the bell crank assembly 40 presses against a lever-activated electrical switch 46. This provides a signal to a control unit, e.g., a microprocessor-controlled electronic control module (not shown), telling the appliance 10 to remain deactivated.

As discussed above, when an aluminum can 18 is inserted into the crushing chamber 16, and the front door 20 is closed, thereby activating the appliance 10, the piston 42 advances upwardly, driven by the bell crank assembly 40. This causes the bell crank assembly 40 to lose contact with the lever-activated switch 46. This sends another signal to the control module (not shown), telling it that the piston 42 and bell crank assembly 40 are no longer in their home position. After the piston 42 has crushed a can and been reciprocated back to its home position by the bell crank assembly 40, the lever-activated switch 46 is once again contacted, thereby telling the control module to deactivate the appliance 10.

Figure 6:
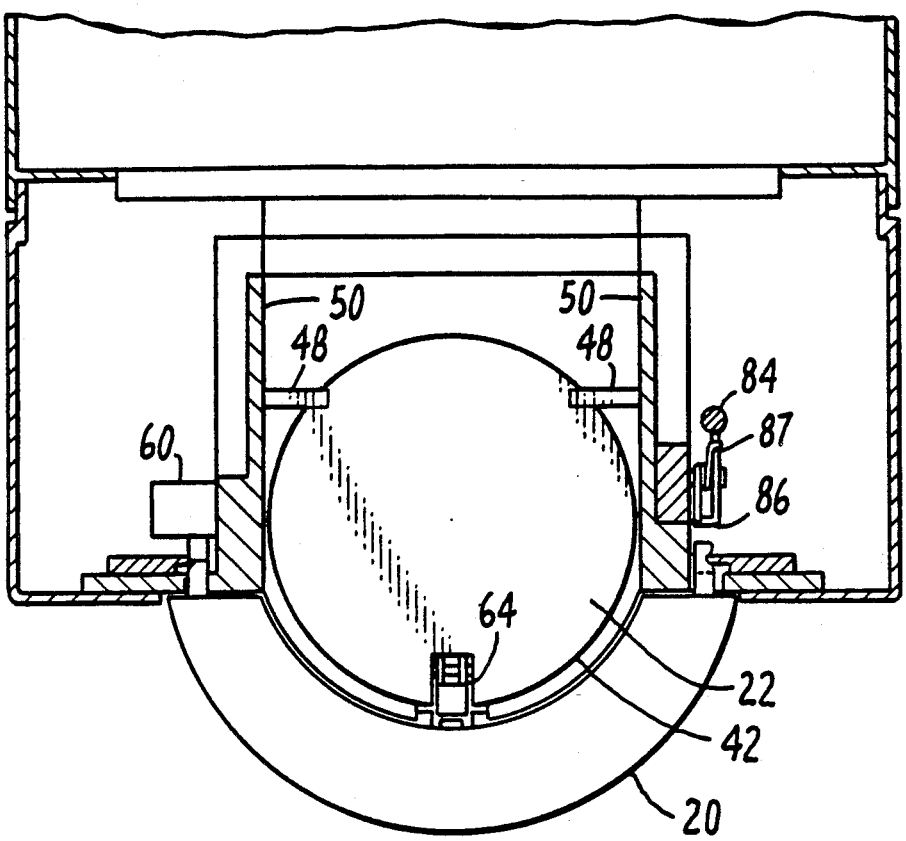
FIG. 6 illustrates a cut-away view taken along line 6—6 in FIG. 5.

Referring to FIG. 6, the top crushing surface 22 of the piston 42 can be seen within the crushing chamber 16. It can be seen that the piston 42 is guided within the crushing chamber 16 as it reciprocates by protruding flanges 48 which slide along grooves (not shown) within the side walls 50 of the crushing chamber 16.

Figure 7:
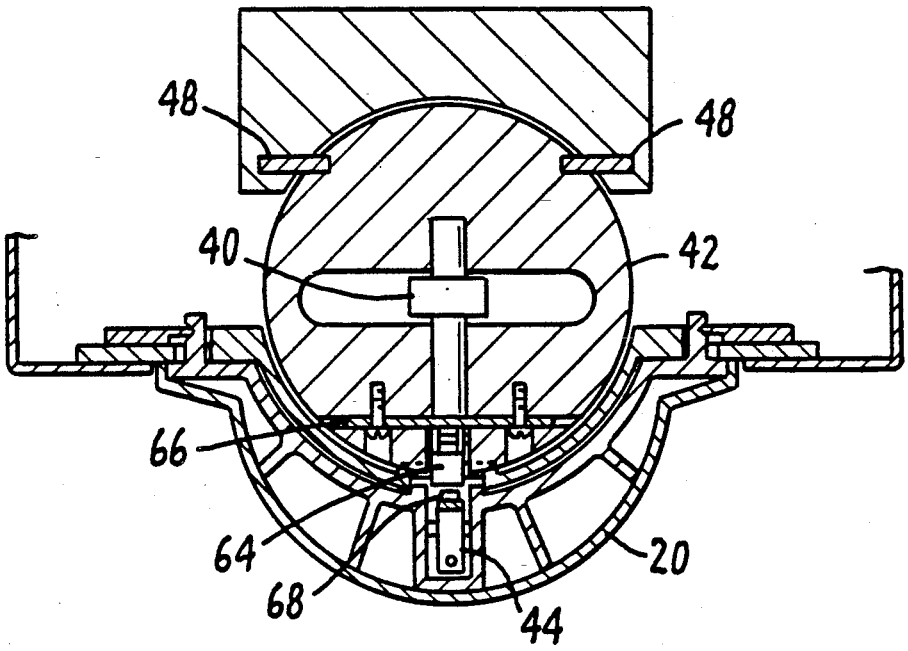
FIG. 7 illustrates a cut-away view taken along line 7—7 in FIG. 5.

Referring to FIG. 7, the bottom side of the piston 42 can be seen with its guide flanges 48. The bell crank assembly 40 is attached to the bottom of the piston 42 by any of several means well known in the art.

Figure 8:
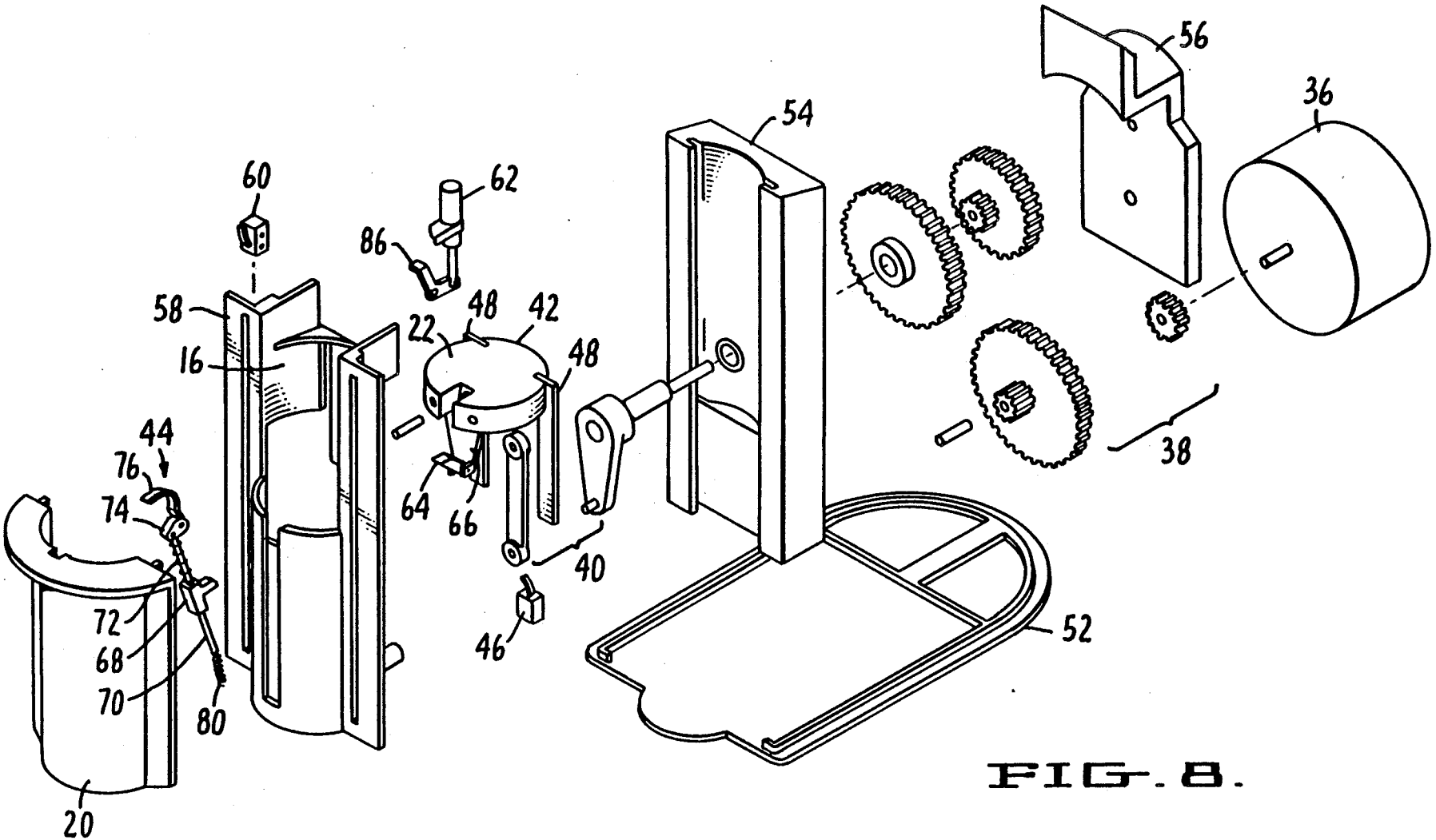
FIG. 8 illustrates an exploded view of the driving and crushing mechanism of the present invention.

Referring to FIG. 8, the primary mechanical driving and crushing components can be seen. A bottom support plate 52 supports a primary structural member 54 and a secondary structural member 56. These two structural members 54, 56 provide the supporting means for mounting the electric motor 36, gear assembly 38 and bell crank assembly 40, as well as providing rigidity for the appliance 10. As discussed above, the piston 42 is coupled to the bell crank assembly 40 for reciprocating within the crushing chamber 16.

The crushing chamber 16 is contained within a front structural member 58, to which the front door 20 (with the ejector mechanism 44) slidably attaches. This front member 58 also provides support for the appliance activation switch 60, discussed more fully below for FIG. 11, and the door lock solenoid assembly 62, discussed more fully below for FIG. 10.

Figure 9:
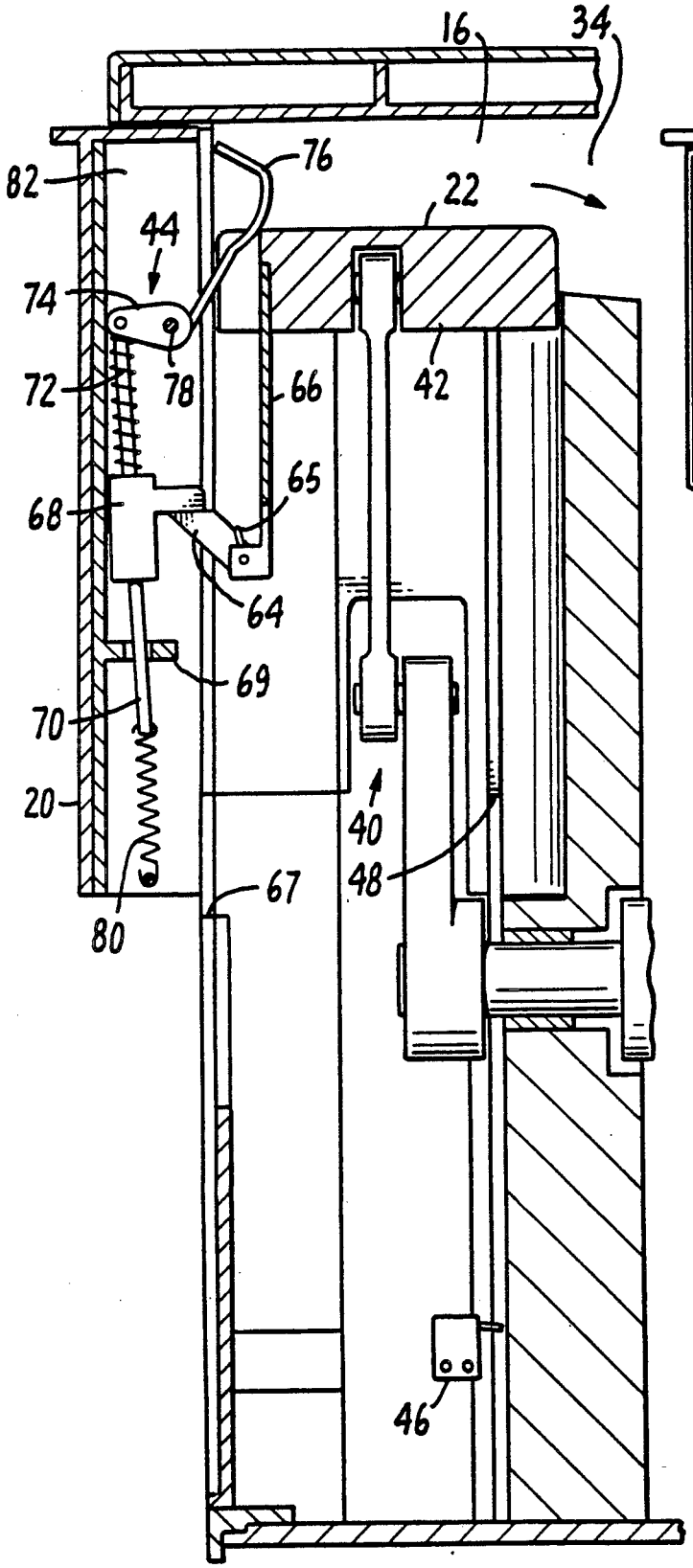
FIG. 9 illustrates a side cut-away view of the present invention approximately half way through a crushing cycle.

Referring to FIG. 9, the spring-loaded ejector mechanism 44 can be seen, and its operation understood. As discussed above, the piston 42 is reciprocated within the crushing chamber 16. When the piston 42 is advanced upwardly within the crushing chamber 16 to crush a can 18 between the lower 22 and upper 24 crushing surfaces, a retractable flange 64, coupled to the piston 42 by a bracket 66 and urged to pivot outwardly therefrom by a spring 65, also advances upwardly. As this flange 64 advances upwardly and clears a front wall 67, it comes into contact with a flanged sleeve 68 on the spring-loaded can ejector mechanism 44. This causes the sleeve 68 to advance upwardly on its shaft 70.

As the sleeve 68 advances upwardly on the shaft 70 it compresses, e.g. "loads," an ejector spring 72. This loaded spring 72 exerts pressure on one end of the lever arm 74 to which the shaft 70 is pivotably coupled. The other end of this lever arm 74, which pivots about a fixed pivot member 78, has a "kicker," or ejector, lever 76 affixed. With a crushed can 18 positioned within the crushing chamber 16 and between the two crushing surfaces 22, 24, the ejector lever 76 is held back, keeping the ejector spring 72 compressed.

However, once the piston 42 begins to recede downwardly, pressure on the crushed can 18 (not shown) is released and the loaded spring 72 forces the lever arm 74 to pivot, thereby causing the ejector lever 76 to intrude into the crushing chamber 16. This has the effect of ejecting the crushed can into the conduit 34, and into the can storage chamber 28, as discussed above.

As the piston 42 continues to recede, its retractable flange 64 advances downwardly, allowing the sleeve 68 to slide back down its shaft 70 until contacting its sleeve stop 69. As the piston 42 and flange 64 continue to recede downwardly, a return spring 80 urges the shaft 70 downwardly, causing the lever arm 74 to pivot back to its original position. This has the effect of withdrawing the ejector lever 76 from the crushing chamber 16 back into the interior 82 of the front door 20. Thus, the crushing chamber 16 is once again free to accept the insertion of another can 18 to be crushed.

Figure 10:
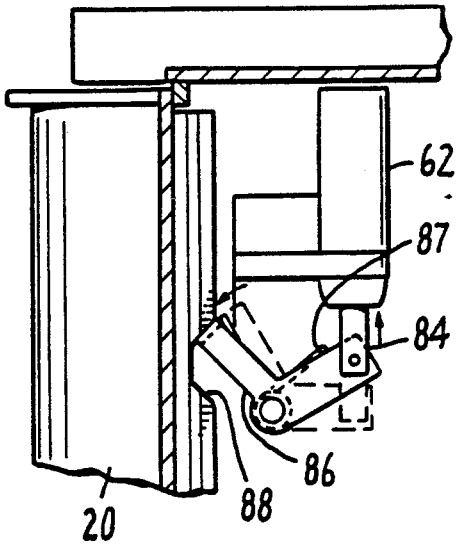
FIG. 10 illustrates a cut-away view taken along line 10—10 in FIG. 5.

Referring to FIG. 10, the door lock solenoid assembly 62 can be seen and its operation understood. When the front door 20 is closed and the appliance 10 activated, a signal from the control module (not shown) activates the door lock solenoid assembly 62. The solenoid shaft 84 advances upwardly, causing a locking lever 86 to pivot into a notch 88 within the backside of the front door 20. This prevents the front door 20 from being opened during the crushing cycle, thereby preventing injury to the user.

After the piston 42 has receded to its home position, as discussed above, a signal from the control module deactivates the solenoid assembly 62, allowing a torsion spring 87 to urge the locking lever 86 to pivot outwardly from the door notch 88. This allows the door 20 to either slide open by the force of gravity, or be slid downwardly by the user when desired.

Figure 11:
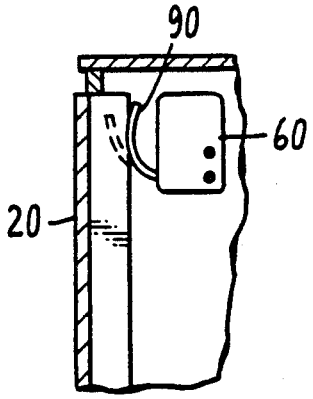
FIG. 11 illustrates a cut-away view taken along line 11—11 in FIG. 5.

Referring to FIG. 11, the appliance activation switch 60 can be seen and its operation understood. When the front door 20 is closed to activate the appliance 10 as discussed above, it contacts the activation lever 90 of the appliance activation switch 60. This causes an activation signal to be sent to the control module (not shown), as discussed above, to activate the appliance 10 for crushing a can 18. Also as discussed above, the appliance 10 is then deactivated once the piston 42 and bell crank assembly 40 return to their home position, thereby contacting the home position switch 46.

It should be understood that various alternatives to the embodiments of the present invention described herein can be employed in practicing the present invention. It is intended that the following claims define the scope of the present invention, and that structures and methods within the scope of these claims and their equivalents be covered thereby.

What is claimed is:

1. A can recycling appliance for receiving a substantially empty aluminum beverage can, crushing said can and storing said crushed can, said appliance comprising:

a housing having a vertically oriented can crushing chamber with a substantially fixed top plate and a vertically movable bottom plate;

a frontal aperture within said housing providing access to said chamber for inserting a can between said top and bottom plates;

reciprocator means for vertically reciprocating said bottom plate within said chamber between a lower position distant from said top plate and an upper position proximate to said top plate;

a can storage receptacle positioned substantially within said housing;

active ejector means positioned substantially within said housing for actively ejecting a crushed can from said chamber; and conveyor means for conveying said ejected can into said can storage receptacle.

2. A appliance as recited in claim 1 further comprising a fluid storage receptacle positioned substantially within said housing an substantially below said can storage receptacle for receiving fluid emanating from said crushed can.

3. An appliance as recited in claim 2, wherein said fluid storage receptacle is removable from said housing.

4. An appliance as recited in claim 1, wherein said reciprocator means comprises an electric motor coupled to drive a bell crank assembly having a lever attached to said bottom plate.

5. An appliance as recited in claim 1, wherein said active ejector means actively ejects a crushed can from said chamber substantially while said reciprocator means reciprocates said bottom plate away from said upper position toward said lower position.

6. An appliance as recited in claim 1, wherein said active ejector means comprises a spring-biased lever mounted within said housing and selectively disposed proximate to said top chamber plate.

7. An appliance as recited in claim 1, wherein said conveyor means comprises a conduit linking said crushing chamber to said storage receptacle.

8. An appliance as recited in claim 1, wherein said can storage receptacle is removable from said housing.

9. A can recycling appliance for recycling aluminum beverage cans comprising:

a housing having a vertically oriented can crushing chamber with a substantially fixed top plate and a vertically movable bottom plate;

a frontal opening within said housing providing access to said chamber for inserting a substantially empty aluminum beverage can between said top and bottom plates;

electric motor coupled to vertically reciprocate said bottom plate within said chamber between a lower position distant from said top plate and an upper position proximate to said top plate;

spring-biased ejection lever mounted to actively eject a crushed can from said chamber;

removable can storage receptacle positioned substantially within said housing; and conduit positioned within said housing linking said chamber and said can storage receptacle for conveying said ejected can into said can storage receptacle.

10. An appliance as recited in claim 9 further comprising a removable fluid storage receptacle positioned substantially within said housing and substantially below said can storage receptacle for receiving fluid emanating from said crushed can.

11. An appliance as recited in claim 9, wherein said spring-biased ejection lever is selectively disposed proximate to said top chamber plate and actively ejects a crushed can from said chamber substantially while said bottom plate reciprocates away from said upper position toward said lower position.

12. A method for recycling aluminum beverage cans comprising the steps of:

inserting a substantially empty aluminum beverage can into a vertically oriented can crushing chamber substantially contained within a housing having a frontal opening providing access thereto, said chamber having a substantially fixed top plate and a vertically movable bottom plate;

crushing said inserted can be vertically reciprocating said bottom plate within said chamber between a lower position distant from said top plate and an upper position proximate to said top plate;

automatically ejecting said crushed can from said chamber by automatically activating a can ejector mechanism substantially contained within said housing; and collecting said ejected can in a removable can storage receptacle substantially contained within said housing and positioned substantially below said top chamber plate.

13. A method as recited in claim 12 further comprising the step of collecting residual fluid emanating from said ejected can in a removable fluid storage receptacle substantially contained within said housing and positioned substantially below said can storage receptacle.

14. A method as recited in claim 12, wherein said step of automatically ejecting said crushed can from said chamber further comprises the step of automatically ejecting said crushed can substantially while said bottom plate reciprocates away from said upper position toward said lower position.

* * * * *